US008962126B2

(12) United States Patent
Tatsuoka et al.

(10) Patent No.: US 8,962,126 B2
(45) Date of Patent: Feb. 24, 2015

(54) SURFACE-COATED CUTTING TOOL HAVING HARD-COATING LAYER WITH EXCELLENT CHIPPING RESISTANCE AND FRACTURING RESISTANCE

(75) Inventors: Sho Tatsuoka, Naka-gun (JP); Kohei Tomita, Tsukuba (JP); Akira Osada, Moriya (JP); Eiji Nakamura, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 408 days.

(21) Appl. No.: 13/364,748

(22) Filed: Feb. 2, 2012

(65) Prior Publication Data

US 2012/0202032 A1 Aug. 9, 2012

(30) Foreign Application Priority Data

Feb. 3, 2011 (JP) ..... 2011-021625
Nov. 18, 2011 (JP) ..... 2011-252224
Jan. 19, 2012 (JP) ..... 2012-008560

(51) Int. Cl.
*B32B 9/04* (2006.01)
*C23C 30/00* (2006.01)

(52) U.S. Cl.
CPC ..... *C23C 30/005* (2013.01)
USPC ..... 428/216; 428/698; 428/699; 428/701; 428/702

(58) Field of Classification Search
CPC ..... C23C 30/005
USPC ..... 428/216
See application file for complete search history.

(56) References Cited

U.S. PATENT DOCUMENTS

2005/0042482 A1 2/2005 Okada et al.

FOREIGN PATENT DOCUMENTS

| | | |
|---|---|---|
| EP | 1655388 A2 | 5/2006 |
| EP | 1905870 A2 | 4/2008 |
| JP | A-2003-019603 | 1/2003 |
| JP | A-2006-205300 | 8/2006 |
| JP | B-4251990 | 4/2009 |

OTHER PUBLICATIONS

European Search Report mailed Apr. 25, 2012 for the corresponding European Application No. 12153629.6.

*Primary Examiner* — Maria Veronica Ewald
*Assistant Examiner* — Laura Auer
(74) *Attorney, Agent, or Firm* — Leason Ellis LLP.

(57) ABSTRACT

A surface-coated cutting tool, which has a hard-coating layer with excellent chipping and fracturing resistances in a high speed intermittent cutting work, is provided. The surface-coated cutting tool includes a cutting tool body, which is made of WC cemented carbide or TiCN-based cermet, and a hard-coating layer, which is vapor deposited on the cutting tool body and has a lower layer and an upper layer. The lower layer is a Ti compound layer, and the upper layer is an aluminum oxide layer. There is a micropore-rich layer in the lower layer in the vicinity of the interface between the lower and upper layers. There are micropores with diameters of 2 to 70 nm in the micropore-rich layer. The diameters of the micropores in the micropore-rich layer shows a bimodal distribution pattern.

3 Claims, 3 Drawing Sheets

* The distribution graph shown above indicates a distribution pattern of micropores with diameters of 0 to 70 nm. the micropores were counted in every 2 nm diameter and the pore number densities were calculated to draw the distribution graph.

SURFACE-COATED CUTTING TOOL HAVING HARD-COATING LAYER WITH EXCELLENT CHIPPING RESISTANCE AND FRACTURING RESISTANCE

TECHNICAL FIELD

The present invention relates to a surface-coated cutting tool (hereinafter referred as a coated cutting tool) retaining an excellent cutting performance for a long period of use in a high speed intermittent cutting operation, in which a high heat is generated and an intermittent-impacting load is subjected to a cutting edge, against a wide variety of steel and cast iron, by endowing an excellent chipping resistance and fracture resistance to its hard-coating layer.

Priority is claimed on Japanese Patent Application No. 2011-021625, filed Feb. 3, 2011, Japanese Patent Application No. 2011-252224, filed Nov. 18, 2011, and Japanese Patent Application No. 2012-8560, Jan. 19, 2012, the content of which is incorporated herein by reference.

BACKGROUND ART

Conventionally, a cutting tool, which includes a cutting tool body and a hard-coating layer made of (a) a lower layer and (b) an upper layer, has been known. The lower layer of the cutting tool is a chemically deposited Ti compound layer composed of one or more of a titanium carbide (hereinafter referred as TiC) layer, a titanium nitride (hereinafter referred as TiN) layer, a titanium carbonitride (hereinafter referred as TiCN) layer, a titanium carboxide (hereinafter referred as TiCO) layer, and a titanium oxycarbonitride (hereinafter referred as TiCNO) layer. The upper layer of the cutting tool is a chemically deposited aluminum oxide layer (hereinafter referred as $Al_2O_3$). Also, conventionally, it has been known that the cutting tool described above can be utilized to a cutting operation of a wide variety of steel and cast iron.

However, chipping and fracturing are prone to occur in a cutting condition where a large load is subjected to its cutting edge in the above mentioned coated cutting tool. As a result, the cutting tool life is shortened. To circumvent this problem, several proposals have been made conventionally.

For example, in a coated cutting tool disclosed in Japanese Patent (Granted) Publication No. 4251990, an intermediate layer made of titanium boronitrilic oxide is provided between the lower and upper layers. By increasing the oxygen content in the intermediate layer from the lower layer side to the upper layer side, the bonding strength between the lower and upper layers of the hard-coating layer is improved. Thus, the chipping resistance of the coated cutting tool is improved.

In a coated cutting tool disclosed in Japanese Unexamined Patent Application, First Publication No. 2006-205300, a hard-coating layer, which has a titanium-based lower layer and an upper layer made of α-alumina layer, is proposed. In the coated cutting tool, titanium oxide portions are dispersively-distributed in a ratio of 1 to 50 parts in a range extending 10 μm in length from the interface between the lower and upper layers. Having the configurations, durability against impacts is improved, preventing the cutting tool from being chipped and fractured. As a result, a cutting tool, not only with excellent chipping resistance and fracturing resistance, but also with wear resistance, is provided. In a coated cutting tool disclosed in Japanese Unexamined Patent Application, First Publication No. 2003-19603, a coated tool with a hard-coating layer including an upper layer. The upper layer is a porous $Al_2O_3$ layer having 5 to 30% of the porosity is proposed. Further a TiN layer is provided on the upper layer as a surface layer. Because of the above-mentioned configurations, thermal and mechanical impacts are absorbed and weakened. As a result, chipping resistance of the cutting tool is improved.

DISCLOSURE OF INVENTION

Problems to be Solved by the Invention

In recent years, there is a strong demand for reducing power and energy in the cutting work. As a result, coated-tools have been used under even more severe conditions. For example, even the coated tools disclosed in Japanese Patent (Granted) Publication No. 4251990, Japanese Unexamined Patent Application, First Publication No. 2006-205300, and Japanese Unexamined Patent Application, First Publication No. 2003-19603 can be chipped or fractured at their cutting edges by a high load in a cutting work, when they are used in a high speed intermittent cutting work where a high temperature is generated and intermittent/impacting loads are subjected on their cutting edges, since the mechanical and thermal impact resistances of the upper layer are not sufficient. As a result, the lifetime of the coated tools expires relatively short period of time.

Under such circumstances, the present inventors intensively studied a coated tool, the hard-coating layer of which has an excellent impact absorbability, even if the coated tool is used in a high speed intermittent cutting work where the intermittent/impacting loads are subjected on its cutting edge. Such coated tool shows excellent chipping and fracturing resistances for long period of time. In the studies, the present inventors obtained the knowledge described below.

One of conventional coated tools has a hard-coating layer with a porous $Al_2O_3$ layer. In the $Al_2O_3$ layer, micro pores, which have a nearly constant diameter, are formed over the entire $Al_2O_3$ layer. As a result, its resistance to mechanical and thermal shock are improved when the porosity is increased. However, when the porosity is increased, strength and hardness at a high temperature of the porous $Al_2O_3$ layer are deteriorated. As a result, the conventional coated tool with the porous $Al_2O_3$ layer cannot show sufficient wear resistance for a long period of time. Also, the lifetime of the coated tool expires relatively short period of time, and not satisfactory.

Improvement of resistances to mechanical and thermal shock of the coated tool can be achieved without compromising the strength and hardness of the $Al_2O_3$ layer at a high temperature. To achieve this, a coated tool having a hard-coating layer on a cutting tool body is provided. The hard-coating layer has a lower layer, which is a titanium compound layer, and an upper layer, which is an $Al_2O_3$ layer. A micropore-rich layer, which includes micropores having a diameter of 2 to 70 nm and has a pre-determined layer thickness, is provided in the lower layer in the vicinity of the interface between the lower and upper layers.

When the relationship between a diameter distribution of micropores (having a diameter of 2 to 70 nm) of the micropore-rich layer and chipping/fracturing resistances of the hard-coating layer was studied, the following knowledge was obtained. The chipping and fracturing resistances can be improved by forming the micropores with a diameter distribution in the bimodal distribution (a distribution with two peaks) in the absence an evenly distributed pattern in the diameter range between 2 nm to 70 nm.

It is more effective to adjust the bimodal distribution as follows. The first peak in the bimodal distribution pattern of the micropores exists between a diameter range of 2 to 10 nm. The density of the micropores at the first peak is 200 to 500 pores/$m^2$, when a window of sections in the frequency distribution is set to 2 nm each of the diameter. The second peak in the bimodal distribution pattern of the micropores exists between a diameter range of 20 to 50 nm. The density of the micropores at the second peak is 10 to 50 pores/$\mu m^2$, when a window of sections in the frequency distribution is set to 2 nm each of the diameter.

A reason for the excellent effect is achieved by having the bimodal distribution of the micropore diameter can be explained as follows. The micropores with a large diameter contribute to absorbing/weakening the thermal and mechanical impact, improving the chipping and fracturing resistances. The micropores with a small diameter contribute to improving an adhesion strength between the lower and upper layers by increasing the number of nucleation of $Al_2O_3$. As a result, fracturing resistance and chipping resistance are improved.

For example, the $Al_2O_3$ layer with micropores having the above-mentioned diameter distribution can be formed by a chemical vapor deposition method described below.

(a) The lower layer is vapor deposited on the surface of the cutting tool body to the intended thickness that is a thickness of the standard Ti compound layer without the portion corresponding to the micropore-rich layer.

(b) $SF_6$ etching is performed by introducing a $SF_6$-based gas in the condition A (explained later), where micropores with the diameter of 2 to 10 nm are mainly formed, immediately after the film forming reaction (a).

(c) Then, vapor deposition of a Ti compound layer is performed again.

(d) $SF_6$ etching is performed by introducing a $SF_6$-based gas in the condition B (explained later), where micropores with the diameter of 20 to 50 nm are mainly formed, immediately after the film forming reaction (c).

(e) Then, vapor deposition of a Ti compound layer is performed again.

(f) The micropore-rich layer is formed by repeating the cycle from (b) to (e) in a pre-determined period and a pre-determined number of cycles.

(g) Then, the $Al_2O_3$ layer is formed as the upper layer by a vapor deposition method using $AlCl_3$—$CO_2$—HCl—$H_2S$—$H_2$ as a reaction gas.

By performing the above-mentioned (a) to (g), the hard-coating layer having lower and upper layers with the intended layer thicknesses is formed on the surface of the cutting tool body. When a cross-section observation is performed to the hard-coating layer with a scanning electron microscope or a transmission electron microscopy, the formation of micropores having the diameter of 2 to 70 nm are observed in the micropore-rich layer in the Ti compound layer in the vicinity of the interface between the lower and upper layers. Furthermore, the distribution pattern of the diameters of the micropores has the bimodal distribution pattern, in which the first peak in the bimodal distribution pattern of the micropores exists between a diameter range of 2 to 10 nm, a density of the micropores at the first peak is 200 to 500 pores/$\mu m^2$, when a window of sections in the frequency distribution is set to 2 nm each of the diameter, the second peak in the bimodal distribution pattern of the micropores exists between a diameter range of 20 to 50 nm, and a density of the micropores at the second peak is 10 to 50 pores/$\mu m^2$, when a window of sections in the frequency distribution is set to 2 nm each of the diameter.

The coated tool, which is an aspect of the present invention, (hereinafter, referred as "coated tool of the present invention") has the micropore-rich layer in the lower layer in the vicinity of the interface between upper and lower layer. The distribution pattern of the diameter of the micropores in the micropore-rich layer is in the bimodal distribution pattern. This coated tool of the present invention has excellent chipping and fracturing resistances even if the coated tool is used in the high speed intermittent cutting work of steel and cast iron, where intermittent and impacting loads are subjected on the cutting edge of the coated tool.

Means for Solving Problem

Aspects of the present invention are shown below.

(1) A surface-coated cutting tool comprising: a cutting tool body consisted of a tungsten carbide based cemented carbide or a titanium carbonitride based cermet; and a hard-coating layer provided on a surface of the cutting tool body, wherein, the hard-coating layer consists of a lower layer and an upper layer; (a) the lower layer is a titanium compound layer that is composed of one or more of a titanium carbide layer, a titanium nitride layer, a titanium carbonitride layer, a titanium carboxide layer, and a titanium oxycarbonitride layer, and has a total mean layer thickness of 3 to 20 μm; (b) the upper layer, which is provided on the lower layer, is an aluminum oxide layer having a mean layer thickness of 1 to 25 μm; and a micropore-rich layer, which includes micropores having a diameter of 2 to 70 nm and has a layer thickness of 0.1 to 1 μm, is provided in the lower layer in the vicinity of the interface between the lower and upper layers.

(2) A surface-coated cutting tool according to the above-mentioned (1), wherein distribution of the diameter of the micropores shows a bimodal distribution pattern.

(3) A surface-coated cutting tool according to the above-mentioned (2), wherein, a first peak in the bimodal distribution pattern of the micropores exists between a diameter range of 2 to 10 nm; a density of the micropores at the first peak is 200 to 500 pores/$\mu m^2$, when a window of sections in the frequency distribution is set to 2 nm each of the diameter; a second peak in the bimodal distribution pattern of the micropores exists between a diameter range of 20 to 50 nm; and a density of the micropores at the second peak is 10 to 50 pores/$\mu m^2$, when a window of sections in the frequency distribution is set to 2 nm each of the diameter.

The coated tool of the present invention has a hard-coating layer including a lower layer, which is a Ti compound layer, and an upper layer, which is $Al_2O_3$ layer. There is a micropore-rich layer in the lower layer in the vicinity of the interface between upper and lower layer. The distribution pattern of the diameter of the micropores in the micropore-rich layer is in the bimodal distribution pattern. This coated tool of the present invention has excellent chipping and fracturing resistances even if the coated tool is used in the high speed intermittent cutting work of steel and cast iron, where intermittent and impacting loads are subjected on the cutting edge of the coated tool. As a result, the coated tool of the present invention shows an excellent wear resistance for a long time period of use and has a long lifetime.

DETAILED DESCRIPTION OF THE INVENTION

Figure 1:
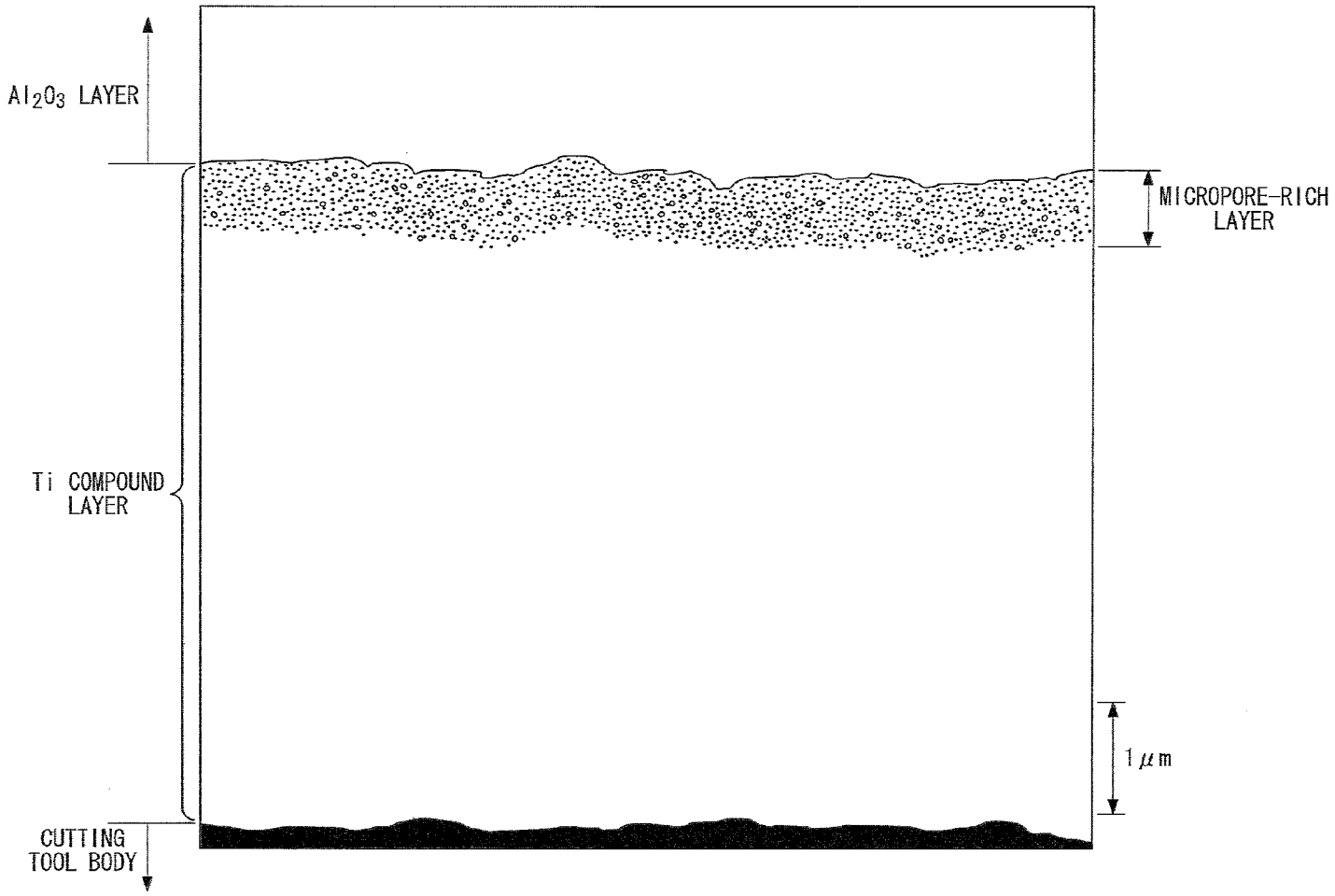
FIG. 1. is a schematic diagram of the micropores in the micropore-rich layer in the lower layer in the vicinity of the interface between the upper and lower layers in the coated tool of the present invention.
Figure 2:
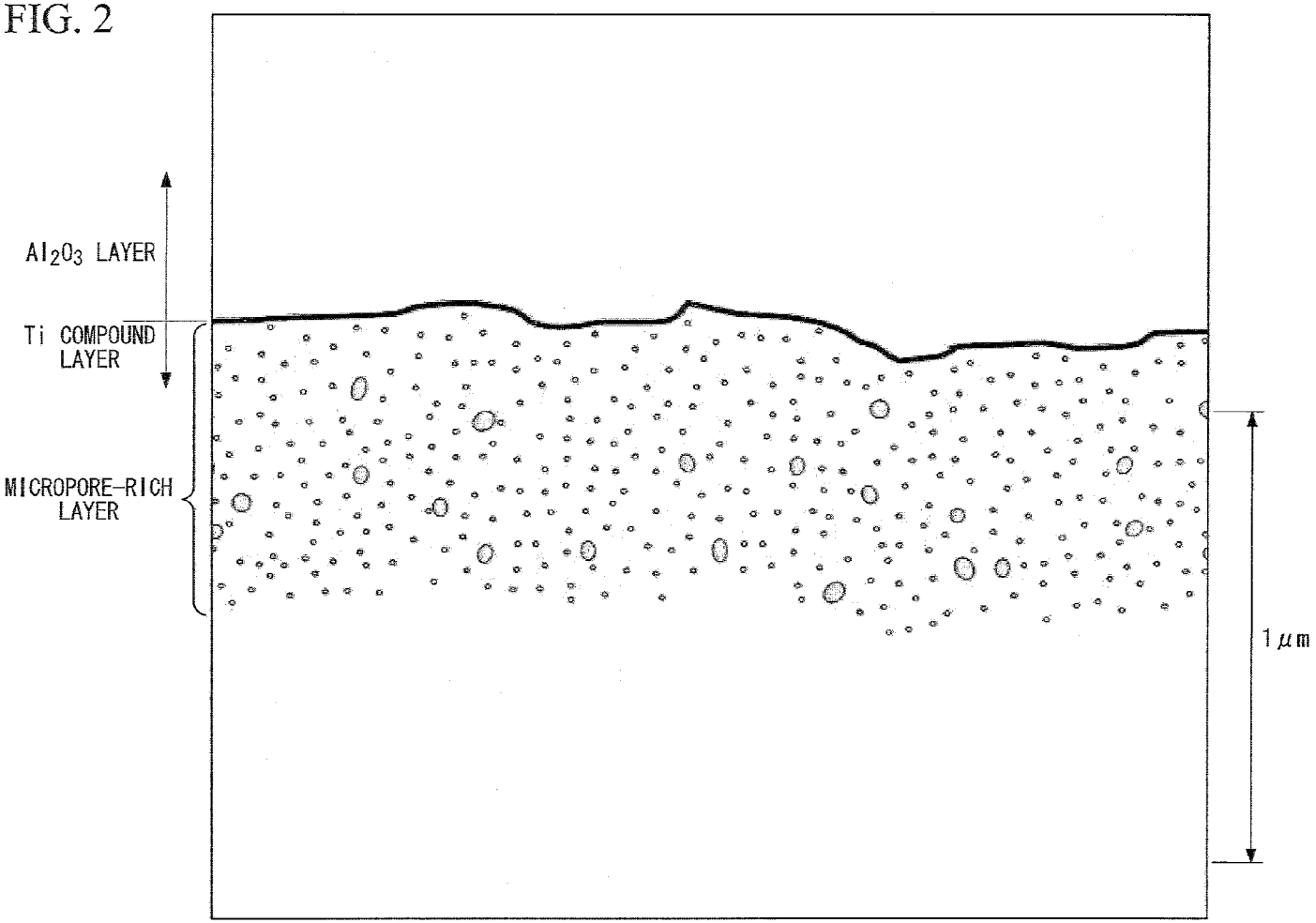
FIG. 2. is a schematic diagram showing an enlarged image of the micropores in the micropore-rich layer in the lower layer in the vicinity of the interface between the upper and lower layers in the coated tool of the present invention.

Best Mode for Carrying Out the Invention

Embodiments of the present invention are explained below in detail.

[Ti Compound Layer in the Lower Layer]

The lower layer, which is a titanium compound layer that is composed of one or more of a titanium carbide layer, a titanium nitride layer, a titanium carbonitride layer, a titanium carboxide layer, and a titanium oxycarbonitride layer, can be formed by chemical vapor deposition in a standard condition. The Ti compound layer has a strength at a high temperature, contributing to a strength at a high temperature of the hard-coating layer. In addition, the Ti compound layer adheres strongly to both the cutting tool body and the upper layer, which is made of $Al_2O_3$ layer. Therefore, the Ti compound layer contributes to improved adhesion of the hard-coating layer to the cutting tool body. When the total average thickness of the Ti compound layer is less than 3 μm, the above-mentioned effects cannot be obtained. On the other hand, when the thickness of the Ti compound layer is more than 20 μm, chipping occurs more frequently. Therefore, the total average thickness of the Ti compound layer is set 3 to 20 μm.

[$Al_2O_3$ Layer in the Upper Layer]

It is well known that the $Al_2O_3$ layer in the upper layer has superior high-temperature hardness and a heat resistance. When the average thickness of the $Al_2O_3$ layer is less than 1 μm, the wear resistance cannot be retained for a long time period of use. On the other hand, when the average thickness of the $Al_2O_3$ layer is more than 25 μm, it becomes easy for the crystal grains of $Al_2O_3$ to be enlarged. As a result, chipping and fracturing resistance are deteriorated in the high speed intermittent cutting work, in addition to reduction of strength and hardness at a high temperature. Thus, the average thickness of the $Al_2O_3$ layer is set 1 to 25

[Micropore-Rich Layer Provided in the Lower Layer in the Vicinity of the Interface Between the Lower and Upper Layers]

There are micropores having diameters of 2 to 70 nm in the lower layer in the vicinity of the interface between the lower and upper layers in the coated tool of the present invention. The lower layer has excellent strength and hardness at a high temperature in a high speed intermittent cutting work where the cutting edge of the coated tool is exposed to a high temperature and subjected to mechanical and thermal shock. At the same time, the lower layer shows excellent chipping and fracturing resistances. Furthermore, even higher chipping and fracturing resistances can be obtained by having the micropore-rich layer with the bimodal (diphasic) diameter distribution pattern, instead of having the micropores with diameters of 2 nm to 70 nm evenly distributed.

[Formation of the Micropore-Rich Layer]

The micropore-rich layer provided to the coated tool of the present invention can be formed by performing etching in two conditions explained below to the surface of the lower layer formed in a standard chemical vapor deposition condition.

The micropore-rich layer having a pre-determined diameter distribution pattern can be formed in the lower layer in the vicinity of the interface between the lower and upper layers by introducing a reaction gas for forming the lower layer and performing etching in alternating two different conditions.

[Condition A]

$SF_6$ etching in the condition A is performed for 5 to 30 minutes under the condition described below.

Reaction gas composition (volume %):

$SF_6$: 5 to 10%

$H_2$: Balance

Temperature of reaction atmosphere: 800 to 950° C.

Pressure of the reaction atmosphere: 4 to 9 kPa.

[Condition B]

$SF_6$ etching in the condition B is performed for 4 to 30 minutes under the condition described below.

Reaction gas composition (volume %):

$SF_6$: 5 to 10%

$H_2$: Balance

Temperature of reaction atmosphere: 1000 to 1050° C.

Pressure of the reaction atmosphere: 13 to 27 kPa.

[Distribution Pattern of Diameters of Micropores in the Micropore-Rich Layer]

A micropore-rich layer is formed in the above-mentioned etching conditions in the micropore-rich layer in the lower layer in the vicinity of the interface between the lower and upper layers. The diameter distribution pattern of the micropores in the micropore-rich layer is shown in FIG. 3.

Figure 3:
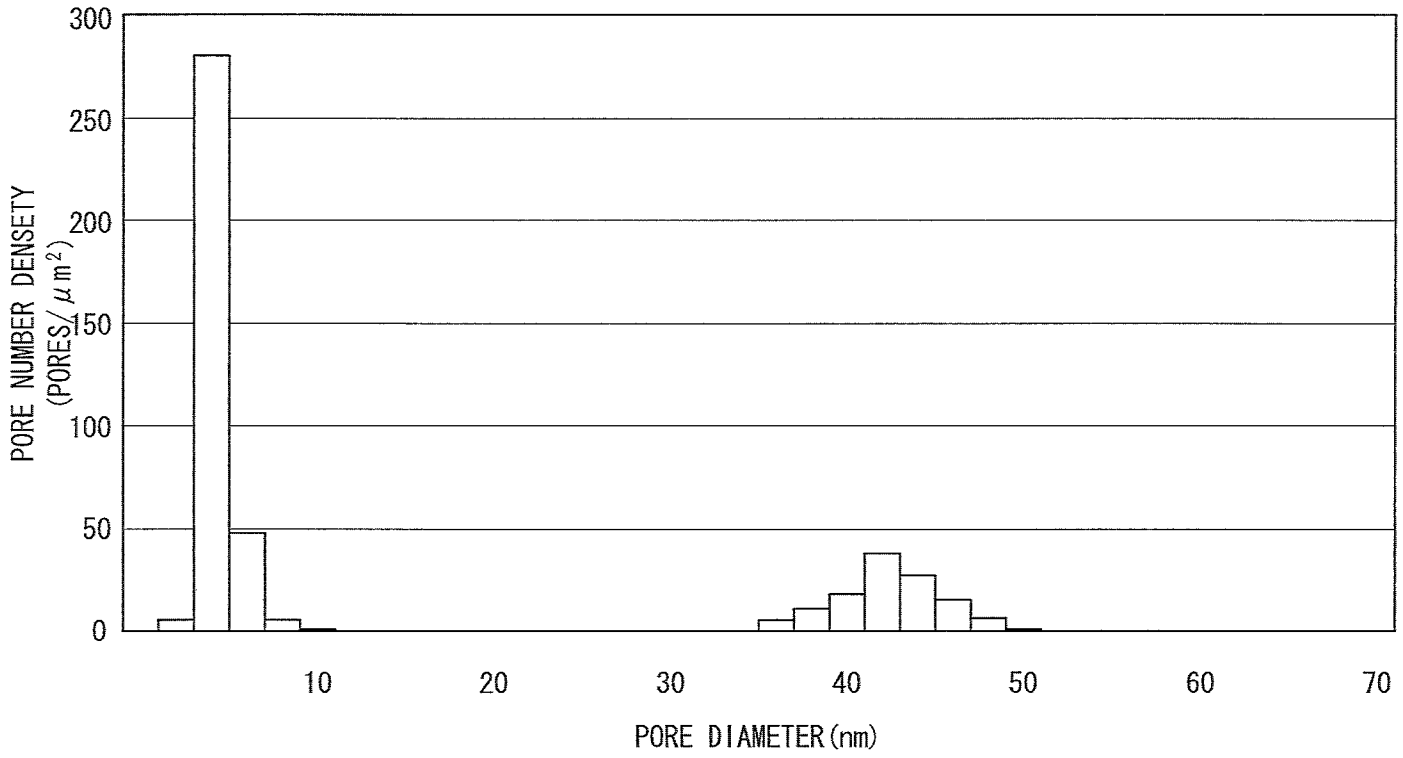
FIG. 3. is a diameter distribution of the micropores in the micropore-rich layer in the lower layer in the vicinity of the interface between the upper and lower layers in the coated tool of the present invention.

As shown in FIG. 3, there are micropores with diameters of 2 to 70 nm in the micropore-rich layer in the lower layer in the vicinity of the interface between the lower and upper layers. The frequency distribution of the diameter of micropore shows a bimodal distribution pattern. In the distribution graph, the first peak (the peak with smaller diameter value in the bimodal pattern) is located between 2 to 10 nm. The density of the micropores at the first peak is 200 to 500 pores/$\mu m^2$, when a window of sections in the frequency distribution is set to 2 nm each of the diameter. The second peak (the peak with larger diameter value in the bimodal pattern) is located between 20 to 50 nm. The density of the micropores at the second peak is 10 to 50 pores/$\mu m^2$, when a window of sections in the frequency distribution is set to 2 nm each of the diameter.

The reason to set the density of the micropore at the first peak at 200 to 500 pores/$\mu m^2$ is explained below. When the density of the micropore with diameters of 2 to 10 nm is less than 200 pores/$\mu m^2$, the number of nucleation of $Al_2O_3$ cannot be increased sufficiently. On the other hand, when the density of the first peak is more than 500 pares/$\mu m^2$, the porosity becomes too high, embrittling the region in the vicinity of the interface between the lower and upper layers and reducing a wear resistance.

The reason to set the density of the micropore at the second peak at 10 to 50 pores/$\mu m^2$ is explained below. When the density of the micropore with diameters of 20 to 50 nm is less than 10 pores/$\mu m^2$ or more than 50 pores/$\mu m^2$, the lower layer cannot absorb/weaken the thermal/mechanical impacts sufficiently. As a result, chipping and fracturing resistances of the coated tool cannot be improved sufficiently.

The reason to set the diameters of the micropores at 2 to 70 nm is explained below. When the diameter of the micropores, which are formed in the micropore-rich layer in the lower layer in the vicinity of the interface between the lower and upper layers, is less than 2 nm, the impact absorbing/weakening effect cannot be obtained. On the other hand, when the diameter of the micropores is more than 70 nm, the toughness of the lower layer is reduced significantly. Therefore, to retain the strength and hardness at a high temperature and the impact absorbing/weakening effect against the intermittent and impacting loads in the lower layer, the diameters of the micropores formed in the lower layer in the vicinity of the interface between the lower and upper layers need to be 2 to 70 nm.

The reason to set the layer thickness of the micropore-rich layer to 0.1 to 1 μm is explained below. When the layer thickness of the micropore-rich layer is less than 0.1 μm, the impact absorbing/weakening effect by the micropores cannot be achieved sufficiently. On the other hand, when it is more than 1 μm, the toughness in the vicinity of the interface between the lower and upper layers is reduced. As a result, chipping and fracturing resistances cannot be achieved sufficiently.

The coated tool of the present invention is specifically explained in detail below referring Examples.

As raw material powders, WC powders, TiC powders, ZrC powders, VC powders, TaC powders, NbC powders, $Cr_3C_2$ powders, TiN powders, and Co powders were prepared. Each particle of all powders has an average diameter of 1 to 3 μm. The above-mentioned powders were blended to the blending composition shown in TABLE 1. Then wax was added to them. Then they were subjected to the ball mill mixing in acetone for 24 hours. Then, the mixtures were press formed at 98 MPa to obtain green compacts, after drying in a reduced pressure. The green compacts were sintered for 1 hours at a pre-determined temperature ranged from 1370 to 1470° C. in vacuum of 5 Pa. After the sintering, the sintered bodies were subjected honing work (R: 0.07 mm) at their cutting edges to obtain the cutting tool bodies A to E made of WC-based cemented carbide with an insert shape defined by ISO•CNMG120408.

Also, TiCN powders (TiC/TiN=50/50 in the mass ratio), $Mo_2C$ powders, ZrC powders, NbC powders, TaC powders, WC powders, Co powders, and Ni powders were prepared as raw material powders. Each particle of all powders has an average diameter of 0.5 to 2 μm. The above-mentioned powders were blended to the blending composition shown in TABLE 2. They were wet-mixed with a ball mill for 24 hours. Then, the mixtures were press formed at 98 MPa to obtain green compacts, after drying in a reduced pressure. The green compacts were sintered for 1 hour at 1540° C. in a nitrogen atmosphere of 1.3 kPa. After the sintering, the sintered bodies were subjected honing work (R: 0.07 mm) at their cutting edges to obtain the cutting tool bodies a to e made of TiCN-based cermet with the insert shape defined by ISO•CNMG120408.

Next, following processes were performed to the surface of the cutting tool bodies A to E, and a to e with a standard chemical vapor deposition apparatus.

(a) As the lower layer of the hard-coating layer, Ti compound layers were vapor deposited in the conditions shown in TABLE 3.

(b) Next, film formation in the process (a) was stopped and $SF_6$ etching was performed for a pre-determined period of time in the condition A shown in TABLE 4. Then, the film forming process (a) was performed again. Then, $SF_6$ etching was performed for a pre-determined period of time in the condition B shown in TABLE 4, Then, the film forming process (a) was performed again.

(c) The micropore-rich layer was formed by repeating the etching cycle, which was described in the process (b), in a pre-determined number, vapor depositing the Ti compound layers to the intended thicknesses as shown in TABLE 5.

(d) Next, the $Al_2O_3$ layers were vapor deposited to the intended layer thicknesses shown in TABLE 3, as the upper layer of the hard-coating layer.

By performing the above-described processes (a) to (d), the coated tools of the present invention 1 to 15 were manufactured. Hard-coating layers were vapor deposited in the coated tools of the present invention 1 to 15. The hard-coating layers include the lower layer shown in TABLE 5, the micropore-rich layer with the bimodal distribution of the diameter distribution in the lower layer in the vicinity of the interface between the lower and upper layers shown in TABLE 6, and the upper layer ($Al_2O_3$ layer) with the intended thicknesses shown in TABLE 5.

In addition, by performing the above-described processes (a) to (d), the coated tools of the present invention 16 to 17 were manufactured. In this case, the process (b) was performed in a single condition shown in TABLE 4. By vapor depositing the hard-coating layer made of the lower layer shown in TABLE 5, the micropore-rich layer including micropores in the lower layer in the vicinity of the interface between the lower and upper layers shown in TABLE 6, and the upper layer ($Al_2O_3$ layer) with the intended layer thicknesses shown in TABLE 5, the coated tools of the present invention 16 to 17 were manufactured.

Ti compound layers in the lower layers of the coated tools of the present invention 1 to 17 were observed through multiples of viewing areas with a scanning electron microscope (magnification: 50000-fold). Existence of the film structure, which is shown in FIG. 1 and includes the micropore-rich layer in the lower layer in the vicinity of the interface between the lower and upper layers, was confirmed in all the coated tools of the present invention 1 to 17.

Then, micropore-rich layers of the coated tool of the present invention 1 to 15, which were located in the lower layers in the vicinity of the interface between the lower and upper layers, were observed with a scanning electron microscope (magnification: 50000-fold) and a transmission electron microscope (magnification: 200000-fold) along the interface in a length of 10 μm in multiple views. When micropores in each of the multiple views were observed, the diameter distribution of the micropores showed the distribution pattern shown in FIG. 3.

Also, for a comparative purpose, Ti compound layers were vapor deposited on the surfaces of the cutting tool bodies A to E and a to e, in the conditions shown in TABLE 3, and to the intended layer thicknesses shown in TABLE 5, as lower layers in the same manner to the coated tools of the present invention 1 to 17.

Then, upper layers made of $Al_2O_3$ were vapor deposited on the lower layer in the conditions shown in TABLE 3, and to the intended layer thicknesses shown in TABLE 5, as the upper layer of the hard-coating layer, to obtain the comparative coated tools 1 to 17.

Thickness of the each constituting layer of the coated tools of the present invention 1 to 17 and the comparative coated tools 1 to 17, were measured with a scanning electron microscope. Each of the constituting layers had average layer thickness that was substantially the same to the intended layer thicknesses shown in TABLE 5.

TABLE 1

| Type | | Blending composition (mass %) | | | | | | | | |
|---|---|---|---|---|---|---|---|---|---|---|
| | | Co | TiC | ZrC | VC | TaC | NbC | $Cr_3C_2$ | TiN | WC |
| Cutting tool body | A | 6.5 | 1.5 | — | — | — | 3.0 | 0.1 | 1.5 | Balance |
| | B | 7.5 | 2.0 | — | — | 4.0 | 0.5 | — | 1.1 | Balance |
| | C | 8.3 | — | 0.5 | — | 0.5 | 2.5 | 0.2 | 2 | Balance |
| | D | 6.5 | — | — | — | 1.7 | 0.2 | — | — | Balance |
| | E | 10 | — | — | 0.2 | — | — | 0.31 | — | Balance |

TABLE 2

| Type | | Blending composition (mass %) | | | | | | | |
|---|---|---|---|---|---|---|---|---|---|
| | | Co | Ni | ZrC | TaC | NbC | $Mo_2C$ | WC | TiCN |
| Cutting tool body | a | 18.5 | 8.5 | — | 10 | — | 10.5 | 16 | Balance |
| | b | 10.5 | — | — | — | 1 | 6 | 10.5 | Balance |
| | c | 12 | 6.5 | — | 11 | 2 | — | — | Balance |

TABLE 2-continued

| Type | | Blending composition (mass %) | | | | | | | |
|---|---|---|---|---|---|---|---|---|---|
| | | Co | Ni | ZrC | TaC | NbC | $Mo_2C$ | WC | TiCN |
| | d | 12 | 7 | 1 | 8 | — | 10.5 | 10.5 | Balance |
| | e | 15 | 8.5 | — | 10 | — | 9.5 | 14.5 | Balance |

TABLE 3

| Constituting layer of the hard-coating layer | | | Coating condition (pressure and temperature of the reaction atmosphere expressed kPa and ° C., respectively) | | |
|---|---|---|---|---|---|
| | | | Composition of the reaction gas | Reaction atmosphere | |
| | Type | Symbol | (volume %) | Pressure | Temperature |
| Ti compound layer | TiC | TiC | $TiCl_4$: 4.2%, $CH_4$: 8.5%, $H_2$: balance | 7 | 1020 |
| | TiN (first layer) | TiN | $TiCl_4$: 4.2%, $N_2$: 30%, $H_2$: balance | 30 | 900 |
| | TiN (other than the first layer) | TiN | $TiCl_4$: 4.2%, $N_2$: 35%, $H_2$: balance | 50 | 1040 |
| | I-TiCN | I-TiCN | $TiCl_4$: 2%, $CH_3CN$: 0.7%, $N_2$: 10%, $H_2$: balance | 7 | 900 |
| | TiCN | TiCN | $TiCl_4$: 2%, $CH_4$: 1%, $N_2$: 15%, $H_2$: balance | 13 | 1000 |
| | TiCO | TiCO | $TiCl_4$: 4.2%, CO: 4%, $H_2$: balance | 7 | 1020 |
| | TiCNO | TiCNO | $TiCl_4$: 2%, CO: 1%, $CH_4$: 1%, $N_2$: 5%, $H_2$: balance | 13 | 1000 |
| $Al_2O_3$ layer | $Al_2O_3$ | $Al_2O_3$ | $AlCl_3$: 2.2%, $CO_2$: 5.5%, HCl: 2.2%, $H_2S$: 0.2%, $H_2$: balance | 7 | 1000 |

TABLE 4

| $SF_6$ etching type | $SF_6$ etching condition symbol | Gas composition (volume %) | Atmosphere pressure (kPa) | Atmosphere temperature (° C.) | Etching time (min) | Number of times of $SF_6$ etching cycle |
|---|---|---|---|---|---|---|
| a | A | $SF_6$: 7%, $H_2$: balance | 5 | 870 | 7 | 13 |
| | B | $SF_6$: 6%, $H_2$: balance | 16 | 1030 | 17 | |
| b | A | $SF_6$: 10%, $H_2$: balance | 7 | 880 | 14 | 19 |
| | B | $SF_6$: 7%, $H_2$: balance | 21 | 1000 | 20 | |
| c | A | $SF_6$: 5%, $H_2$: balance | 8 | 930 | 15 | 15 |
| | B | $SF_6$: 10%, $H_2$: balance | 17 | 1020 | 8 | |
| d | A | $SF_6$: 6%, $H_2$: balance | 7 | 800 | 12 | 13 |
| | B | $SF_6$: 7%, $H_2$: balance | 16 | 1040 | 5 | |
| e | A | $SF_6$: 6%, $H_2$: balance | 9 | 840 | 17 | 18 |
| | B | $SF_6$: 8%, $H_2$: balance | 27 | 1020 | 26 | |
| f | A | $SF_6$: 10%, $H_2$: balance | 7 | 890 | 8 | 15 |
| | B | $SF_6$: 7%, $H_2$: balance | 27 | 1050 | 10 | |
| g | A | $SF_6$: 8%, $H_2$: balance | 8 | 930 | 30 | 23 |
| | B | $SF_6$: 5%, $H_2$: balance | 23 | 1010 | 30 | |
| h | A | $SF_6$: 5%, $H_2$: balance | 4 | 800 | 24 | 16 |
| | B | $SF_6$: 7%, $H_2$: balance | 24 | 1040 | 4 | |
| i | A | $SF_6$: 7%, $H_2$: balance | 5 | 930 | 5 | 12 |
| | B | $SF_6$: 5%, $H_2$: balance | 25 | 1050 | 10 | |
| j | A | $SF_6$: 6%, $H_2$: balance | 7 | 870 | 10 | 13 |

TABLE 4-continued

| $SF_6$ etching type | $SF_6$ etching condition symbol | Gas composition (volume %) | Atmosphere pressure (kPa) | Atmosphere temperature (° C.) | Etching time (min) | Number of times of $SF_6$ etching cycle |
|---|---|---|---|---|---|---|
| | B | $SF_6$: 8%, $H_2$: balance | 21 | 1020 | 8 | |
| k | A | $SF_6$: 8%, $H_2$: balance | 7 | 930 | 7 | 13 |
| | B | $SF_6$: 9%, $H_2$: balance | 16 | 1020 | 6 | |
| l | A | $SF_6$: 5%, $H_2$: balance | 5 | 810 | 5 | 12 |
| | B | $SF_6$: 6%, $H_2$: balance | 15 | 1040 | 22 | |
| m | A | $SF_6$: 7%, $H_2$: balance | 8 | 920 | 20 | 19 |
| | B | $SF_6$: 10%, $H_2$: balance | 20 | 1020 | 7 | |
| n | A | $SF_6$: 7%, $H_2$: balance | 5 | 890 | 6 | 12 |
| | B | $SF_6$: 6%, $H_2$: balance | 20 | 1030 | 5 | |
| o | A | $SF_6$: 9%, $H_2$: balance | 9 | 950 | 22 | 22 |
| | B | $SF_6$: 5%, $H_2$: balance | 13 | 1000 | 4 | |
| p* | | $SF_6$: 7%, $H_2$: balance | 5 | 920 | 7 | 16 |
| q* | | $SF_6$: 7%, $H_2$: balance | 22 | 1030 | 6 | 20 |

*In $SF_6$ etching types p and q, a single type of $SF_6$ etching was performed in the number of times of $SF_6$ etching cycle.

TABLE 5

| Type | | Cutting tool body symbol | Lower layer of the hard-coating layer (Numbers in parentheses indicate the intended layer thickness (μm) of the layer) First layer | Second layer | Third layer | Fourth layer | Average intended total layer thickness (μm) | Upper layer of the hard-coating layer ($Al_2O_3$) Average intended layer thickness (μm) |
|---|---|---|---|---|---|---|---|---|
| Coated tools of the present invention/comparative coated tools | 1 | a | TiN (1) | I—TiCN (17.5) | TiN (1) | TiCNO (0.5) | 20 | 7 |
| | 2 | A | TiCN (1) | I—TiCN (8.5) | TiCO (0.5) | — | 10 | 4 |
| | 3 | b | TiN (1) | I—TiCN (4) | TiC (4) | TiCNO (1) | 10 | 15 |
| | 4 | B | TiC (1) | I—TiCN (9) | — | — | 10 | 1 |
| | 5 | c | TiN (1) | I—TiCN (4.5) | TiCNO (0.5) | — | 6 | 25 |
| | 6 | C | TiN (0.5) | I—TiCN (1.5) | TiC (0.5) | TiCNO (0.5) | 3 | 12 |
| | 7 | d | TiN (0.5) | I—TiCN (10) | TiC (2) | TiCNO (0.3) | 12.8 | 5 |
| | 8 | D | TiN (1) | TiCN (19) | — | — | 20 | 6 |
| | 9 | e | TiC (0.5) | I—TiCN (9) | TiCO (0.5) | — | 10 | 13 |
| | 10 | E | TiN (1) | TiC (1) | TiCN (7) | TiCO (1) | 10 | 4 |
| | 11 | A | TiN (0.3) | I—TiCN (5) | TiCNO (0.7) | TiCO (0.1) | 6.1 | 22 |
| | 12 | a | TiN (1) | I—TiCN (10) | TiCO (0.5) | — | 11.5 | 2 |
| | 13 | B | TiN (0.5) | I—TiCN (12) | TiN (0.5) | TiCNO (0.2) | 13.2 | 9 |
| | 14 | b | TiN (0.6) | I—TiCN (7) | TiCNO (0.3) | — | 7.9 | 16 |
| | 15 | C | TiN (0.4) | I—TiCN (3) | TiCN (0.5) | TiCO (0.1) | 4 | 7 |
| | 16 | c | TiN (0.4) | I—TiCN (6) | TiCO (0.4) | — | 6.8 | 6 |
| | 17 | D | TiN (0.3) | I—TiCN (8) | TiCNO (0.5) | TiCO (0.2) | 9 | 3 |

TABLE 6

| Type | | Cutting tool body symbol | $SF_6$ etching type | Micropore-rich layer: Layer thickness of micropore-rich layer (μm) | First peak (diameter: 2 to 10 nm) of micropores in the diameter distribution graph: Pore density (pores/μm$^2$) | First peak: Peak location (nm) | Second peak (diameter: 20 to 50 nm) of micropores in the diameter distribution graph: Pore density (pores/μm$^2$) | Second peak: Peak location (nm) |
|---|---|---|---|---|---|---|---|---|
| Coated tools of the present invention | 1 | a | a | 0.3 | 222 | 6 | 29 | 26 |
| | 2 | A | b | 0.5 | 345 | 6 | 39 | 36 |
| | 3 | b | c | 0.8 | 270 | 8 | 25 | 28 |
| | 4 | B | d | 1 | 249 | 4 | 16 | 26 |
| | 5 | c | e | 0.4 | 300 | 8 | 50 | 48 |
| | 6 | C | f | 0.5 | 268 | 6 | 28 | 50 |
| | 7 | d | g | 0.2 | 500 | 8 | 41 | 40 |
| | 8 | D | h | 0.9 | 303 | 2 | 18 | 44 |
| | 9 | e | i | 0.1 | 210 | 6 | 23 | 48 |
| | 10 | E | j | 0.6 | 240 | 6 | 24 | 36 |
| | 11 | A | k | 0.1 | 241 | 8 | 19 | 24 |
| | 12 | a | l | 0.4 | 200 | 4 | 35 | 22 |
| | 13 | B | m | 0.2 | 353 | 8 | 24 | 34 |
| | 14 | b | n | 0.3 | 215 | 6 | 16 | 34 |
| | 15 | C | o | 0.1 | 435 | 10 | 10 | 20 |
| | 16 | c | p | 0.4 | 218* | 6* | —* | —* |
| | 17 | D | q | 0.2 | —* | —* | 18* | 42* |

*In types 16 and 17, pore diameter distributions did not show the bimodal distribution pattern. In the type 16, the peak of the pore diameter distribution was located at 6 nm, which was within the range of 2 to 10 nm. In the type 17, the peak of the pore diameter distribution was located at 42 nm, which was within the range of 20 to 50 nm.

Next, a cutting tool test was performed in the conditions shown in TABLE 7, using the coated tools of the present invention 1 to 17 and the comparative coated cutting tools 1 to 17. In the cutting tool test, amount of flank wear of the coated tool was measured.

The results of the measurements in the test were indicated in TABLE 8

TABLE 7

| Conditions for high speed intermittent cutting | Cutting test 1 (high speed intermittent cutting of alloy steel) | Cutting test 2 (high speed intermittent cutting of carbon steel) | Cutting test 3 (high speed intermittent cutting of cast iron) |
|---|---|---|---|
| Workpiece | SCM445 | S15C | FC300 |
| Cutting speed | 385 m/min | 390 m/min | 400 m/min |
| Feed | 0.26 mm/rev | 0.5 mm/rev | 0.3 mm/rev |
| Depth of cut | 3 mm | 2 mm | 2 mm |
| Cutting fluid | Unused | Unused | Used |
| Cutting time | 5 min | 5 min | 5 min |
| Remarks | Standard cutting speed: 200 m/min | Standard cutting speed: 250 m/min | Standard cutting speed: 250 m/min |

Note:

The workpiece used in the tests is a round bar with four grooves extending in the longitudinal direction of the bar. The four grooves are equally spaced on the outer peripheral surface of the bar.

TABLE 8

| Type | | Amount of flank wear (mm): Cutting condition 1 | Cutting condition 2 | Cutting condition 3 | Type | | Cutting test result (min): Cutting condition 1 | Cutting condition 2 | Cutting condition 3 |
|---|---|---|---|---|---|---|---|---|---|
| Coated tools of the present invention | 1 | 0.22 | 0.20 | 0.24 | Comparative coated tools | 1 | 1.6 | 3.3 | 2.7 |
| | 2 | 0.23 | 0.20 | 0.22 | | 2 | 1.8 | 3.5 | 3.3 |
| | 3 | 0.19 | 0.16 | 0.18 | | 3 | 1.0 | 1.6 | 1.4 |
| | 4 | 0.27 | 0.28 | 0.29 | | 4 | 2.5 | 4.3 | 4.8 |
| | 5 | 0.15 | 0.14 | 0.16 | | 5 | 0.7 | 1.0 | 1.3 |
| | 6 | 0.22 | 0.20 | 0.22 | | 6 | 1.4 | 3.0 | 2.2 |
| | 7 | 0.21 | 0.19 | 0.22 | | 7 | 2.1 | 3.7 | 3.5 |
| | 8 | 0.19 | 0.18 | 0.22 | | 8 | 1.5 | 2.5 | 3.6 |
| | 9 | 0.18 | 0.16 | 0.18 | | 9 | 1.4 | 2.3 | 2.4 |
| | 10 | 0.23 | 0.28 | 0.24 | | 10 | 2.0 | 4.0 | 3.2 |
| | 11 | 0.18 | 0.16 | 0.19 | | 11 | 0.9 | 1.6 | 1.9 |
| | 12 | 0.26 | 0.29 | 0.25 | | 12 | 3.2 | 4.5 | 4.5 |
| | 13 | 0.25 | 0.20 | 0.22 | | 13 | 1.8 | 2.7 | 3.4 |
| | 14 | 0.20 | 0.20 | 0.19 | | 14 | 1.0 | 1.3 | 1.8 |
| | 15 | 0.22 | 0.23 | 0.22 | | 15 | 1.6 | 3.1 | 3.1 |

TABLE 8-continued

| Type | Amount of flank wear (mm) | | | Type | Cutting test result (min) | | |
|---|---|---|---|---|---|---|---|
| | Cutting condition 1 | Cutting condition 2 | Cutting condition 3 | | Cutting condition 1 | Cutting condition 2 | Cutting condition 3 |
| 16 | 0.27 | 0.29 | 0.27 | 16 | 0.7 | 1.3 | 1.4 |
| 17 | 0.28 | 0.28 | 0.29 | 17 | 0.9 | 2.3 | 2.4 |

Note:

The cutting test result for the comparative coated tools 1 to 17 is the cutting time (min) that the lifetime of the comparative coated tools was expired due to chipping, fracturing, or the like.

The results shown in TABLES 5 to 8 demonstrates followings. The coated tools of the present invention have a micropore-rich layer with a pre-determined diameter distribution in the lower layer in the vicinity of the interface between the lower and upper layers. The coated tools of the present invention 1 to 17 showed excellent chipping and fracturing resistances even if they were used in a high speed intermittent cutting work on steel, cast iron, or etc, where a high heat is generated and high intermittent impacting loads are subjected on their cutting edges, because of the above-mentioned configuration. As a result, the coated tool of the present invention 1 to 17 show an excellent wear resistance for long time period of use. Furthermore, it was clearly demonstrated that the coated tools of the present invention 1 to 17 showed even more excellent wear resistance, when the micropore-rich layer had a pre-determined micropore diameter distribution.

The results shown in TABLES 5 to 8 also demonstrates followings. The comparative coated tools 1 to 17 do not have the micropore-rich layer with a pre-determined diameter distribution. When these comparative coated tools 1 to 15 were used in the high speed intermittent cutting work, where the high heat is generated and high intermittent impacting loads are subjected on their cutting edges, their lifetime expired in a short period of time due to occurrence of chipping, fracturing, or the like.

INDUSTRIAL APPLICABILITY

The coated tool, which is an aspect of the present invention, shows excellent chipping and fracturing resistances in a high speed intermittent cutting work to steel, cast iron, or etc, where high heat is generated and high intermittent impacting loads are subjected on its cutting edge. As a result, the lifetime of the coated tool is extended. In addition, the technical effects described above can be obtained not only in the high speed intermittent cutting work, but in a high speed cutting condition, a high speed heavy cutting work condition such as a high depth cutting and a high feed cutting, or the like.

The invention claimed is:

1. A surface-coated cutting tool comprising:

a cutting tool body consisted of a tungsten carbide based cemented carbide or a titanium carbonitride based cermet; and a hard-coating layer provided on a surface of the cutting tool body, wherein, the hard-coating layer consists of a lower layer and an upper layer;

(a) the lower layer is a titanium compound layer that is composed of one or more of a titanium carbide layer, a titanium nitride layer, a titanium carbonitride layer, a titanium carboxide layer, and a titanium oxycarbonitride layer, and has a total mean layer thickness of 3 to 20 μm;

(b) the upper layer, which is provided on the lower layer, is an aluminum oxide layer having a mean layer thickness of 1 to 25 μm; and a micropore-rich layer, which includes micropores having a diameter of 2 to 70 nm and has a layer thickness of 0.1 to 1 μm, is provided in the lower layer in a vicinity of an interface between the lower and upper layers, wherein the vicinity originates from the interface.

2. A surface-coated cutting tool according to claim 1, wherein distribution of the diameter of the micropores shows a bimodal distribution pattern.

3. A surface-coated cutting tool according to claim 2, wherein, a first peak in the bimodal distribution pattern of the diameter of the micropores exists between a diameter range of 2 to 10 nm;

a density of the micropores at the first peak is 200 to 500 pores/$\mu m^2$, when the distribution of the diameter of the micropores are counted in 2 nm intervals;

a second peak in the bimodal distribution pattern of the diameter of the micropores exists between a diameter range of 20 to 50 nm; and a density of the micropores at the second peak is 10 to 50 pores/$\mu m^2$, when the distribution of the diameter of the micropores are counted in 2 nm intervals.

* * * * *